US005314261A

United States Patent [19]

Stephens

[11] Patent Number: 5,314,261

[45] Date of Patent: May 24, 1994

[54] VEHICLE CRASH CUSHION

[75] Inventor: Barry D. Stephens, Roseville, Calif.

[73] Assignee: Energy Absorption Systems, Inc., Chicago, Ill.

[21] Appl. No.: 16,685

[22] Filed: Feb. 11, 1993

[51] Int. Cl.[5] ..... E01F 15/00

[52] U.S. Cl. ..... 404/6; 256/13.1

[58] Field of Search ..... 404/6, 9, 7; 256/1, 256/13.1; 267/116, 139; 104/254; 114/219

[56] References Cited

U.S. PATENT DOCUMENTS

| | | | |
|---|---|---|---|
| 3,173,270 | 3/1965 | Blancato | 104/254 X |
| 3,541,800 | 11/1970 | Walker et al. . | |
| 3,666,055 | 5/1972 | Walker et al. . | |
| 3,672,657 | 6/1972 | Young et al. . | |
| 3,674,115 | 7/1972 | Young et al. . | |
| 3,845,936 | 11/1974 | Boedecker, Jr. et al. | 256/1 |
| 3,944,187 | 3/1976 | Walker | 256/1 X |
| 3,982,734 | 9/1976 | Walker . | |
| 4,073,482 | 2/1978 | Seegmiller . | |
| 4,289,419 | 9/1981 | Young et al. . | |
| 4,583,716 | 4/1986 | Stephens et al. | 188/377 X |
| 4,645,375 | 2/1987 | Carney, III | 404/6 |

OTHER PUBLICATIONS

Anderson Safeway: "Keeping 40,000 Pounds v: Bus Down to Earth" (undated).

Southwest Research Institute: "Serb—A New High Performance Self-Restoring Traffic Barrier" (Jan. 1981).

Southwest Research Institute: "Design and Development of Self-Restoring Traffic Barriers" (Jan. 1984).

U.S. Department of Transportation—Federal Highway Administration: "Self-Restoring Median Barriers and Bridge Railings—Research Report", Report No. FHWA/RD-87/002 (Jan. 1987).

*Primary Examiner*—Ramon S. Britts

*Assistant Examiner*—James A. Lisehora

[57] ABSTRACT

A vehicle crash cushion is mounted to a wall adjacent to a roadway. The cushion includes an array of panels positioned to overlap one another and oriented parallel to the wall. A mechanical linkage couples the panels to the wall and suspends the panels above grade such that the panels are movable toward the wall. Energy absorbing elastomeric tubes are positioned between the panels and the wall such that movement of the panels toward the wall deforms the energy absorbing elements, thereby retarding movement of the panels toward the wall.

16 Claims, 5 Drawing Sheets 44
42
42
40
48
36
38
14
30
30
36
16
28
18
26
19
20
46
22
34
24
26
10
24
W

VEHICLE CRASH CUSHION

BACKGROUND OF THE INVENTION

This invention relates to a vehicle crash cushion for decelerating a vehicle that has left a roadway and is moving toward a wall.

Young U.S. Pat. No. 3,672,657 (assigned to the assignee of the present invention) discloses a vehicle crash cushion of the general type defined above. The Young system includes an array of parallel diaphragms with water-filled energy absorbing elements between the diaphragms. The outermost diaphragms are arranged to overlap, and the entire assembly is mounted to slide on slide plates perpendicular or adjacent to a wall. An impacting vehicle will move the outermost diaphragms toward the wall, thereby accelerating water in the energy absorbing elements. In this way, the severity of the impact between the vehicle and the wall is substantially reduced.

The Young crash cushion has shown itself to be quite effective in actual use. In one installation the Young crash cushion was placed on a wall at a freeway turn in Detroit. Over ten years of practical experience have shown a substantial reduction in serious injuries and fatalities.

Nevertheless, the Young crash cushion is not without drawbacks, primarily with respect to the level of maintenance required to maintain the crash cushion in an operational condition. It has been found that there is a tendency for the outermost diaphragms not to return to the original position after an impact. In some applications this may require that an entire freeway be shut down while the outer diaphragms are pulled back to the operational position. In practice there is a tendency to delay such maintenance, and the diaphragms themselves are more susceptible to damage if hit by a second impact at a time when they have not recovered properly from the first. Furthermore, the Young crash cushion includes a number of interior diaphragms which are susceptible to damage in a severe impact. Certain elements are formed of wood, which are susceptible to water damage and rotting, and debris such as sand and litter tends to be trapped within the system. It is difficult to remove this debris, and excessive sand can build up inside the unit and interfere with the operation of the crash cushion.

The present invention is directed to an improved vehicle crash cushion which is less susceptible to the maintenance problems of the Young crash cushion described above.

SUMMARY OF THE INVENTION

According to this invention, a vehicle crash cushion is provided for decelerating a vehicle that has left a roadway and is moving toward a wall. The barrier of this invention comprises a plurality of panels positioned to overlap one another partially along an anticipated impact direction. A mechanical linkage is coupled to the panels to suspend the panels above grade adjacent to the wall such that the panels are oriented generally parallel to the wall, and the panels are movable toward the wall in an impact. A plurality of energy absorbing elements are positioned adjacent to the panels between the panels and the wall and are suspended above grade at least in part by the linkage, such that movement of the panels toward the wall deforms the energy absorbing elements, thereby retarding movement of the panels.

DETAILED DESCRIPTION OF THE PRESENTLY PREFERRED EMBODIMENTS

Figure 2:
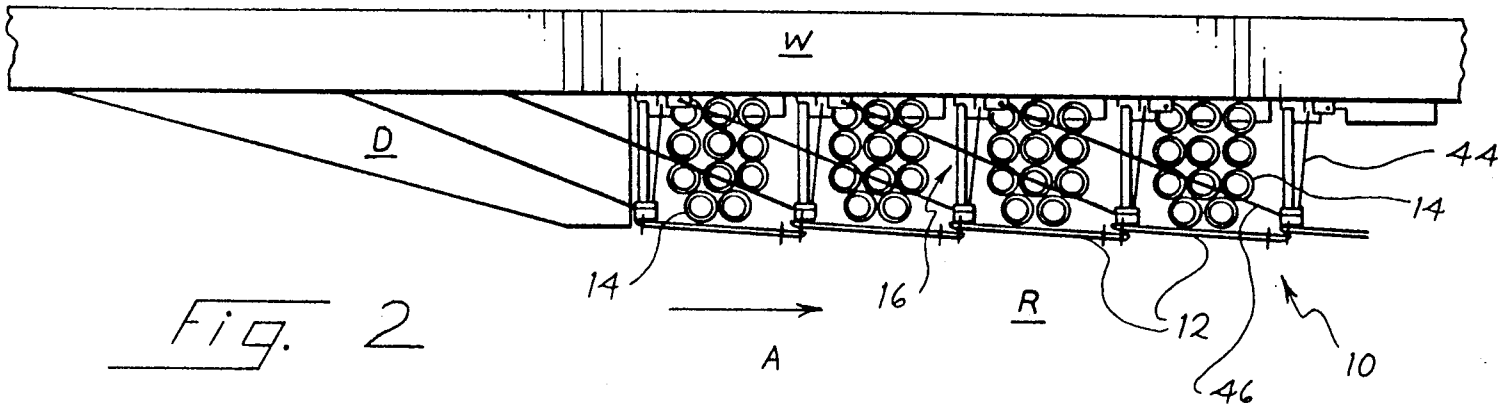
FIG. 2 is a plan view taken along line 2—2 of FIG. 1.
Figure 3:
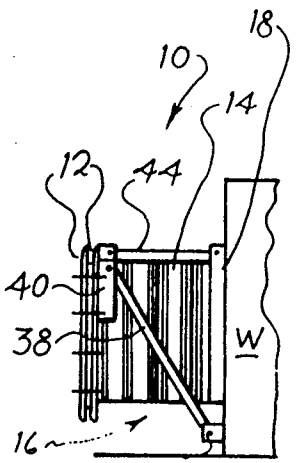
FIG. 3 is an end view taken along line 3—3 of FIG. 1.
Figure 1:
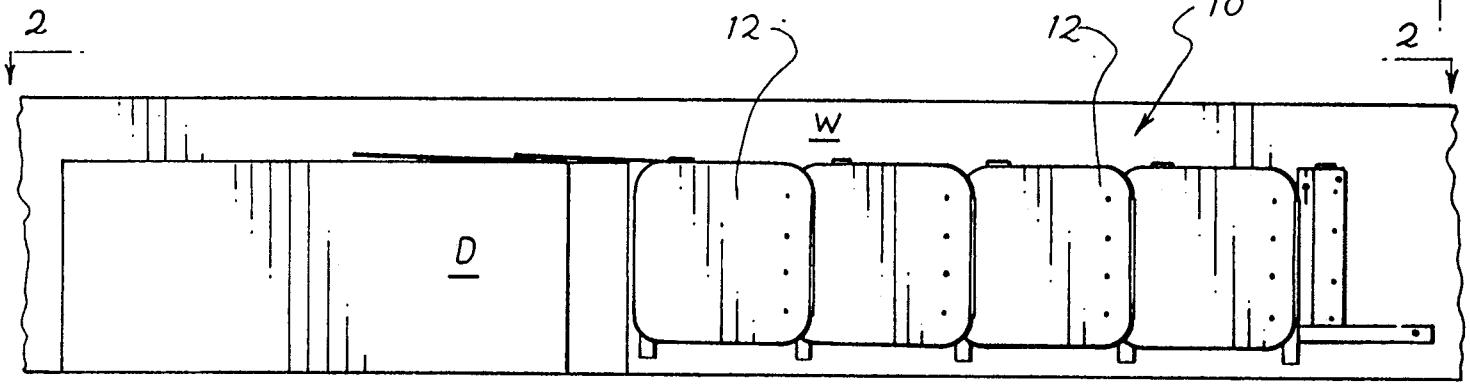
FIG. 1 is an elevational view of a preferred embodiment of the crash cushion of this invention adjacent a wall.

Turning now to the drawings, FIGS. 1-3 show overall views of a crash cushion 10 which incorporates a presently preferred embodiment of this invention. This crash cushion 10 is mounted alongside a wall W positioned adjacent to a roadway R. In this example vehicles that travel along the roadway move in the direction of the arrow A, which is therefore generally oriented in the anticipated direction of impact of a vehicle against the cushion 10. Though the wall W is shown as a retaining wall, it should be understood that the term "wall" is used broadly in this specification and the following claims to cover longitudinally extending fixed obstacles such as walls of various heights, as well as bridge piers, medians and the like. A rigid deflecting wedge D prevents impacting vehicles from striking the forward end of the crash cushion 10.

As generally shown in FIG. 2, the cushion 10 includes an array of panels 12 arranged side by side in overlapping configuration spaced from and generally parallel to the wall W. Clusters of energy absorbing elements 14 are interposed between the panels 12 and the wall W, and the panels 12 are suspended in place above the level of the roadway R by a linkage 16 (FIG. 3). The following paragraphs will describe each of these elements of the crash cushion 10 in detail, before turning to a discussion of the operation of the crash cushion 10.

Figure 4:
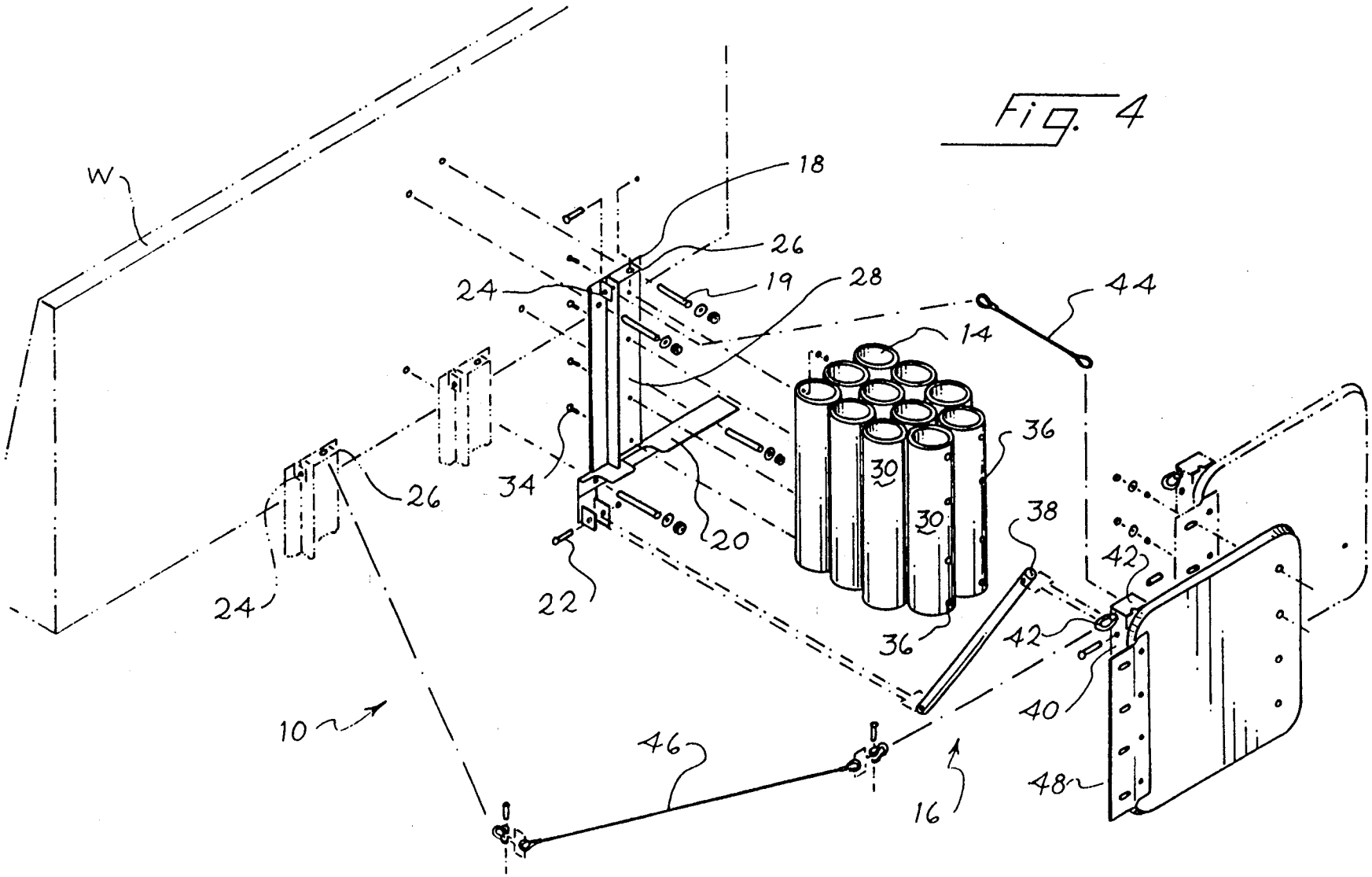
FIG. 4 is an exploded perspective view of one of the modular units of the crash cushion of FIG. 1.
Figure 7:
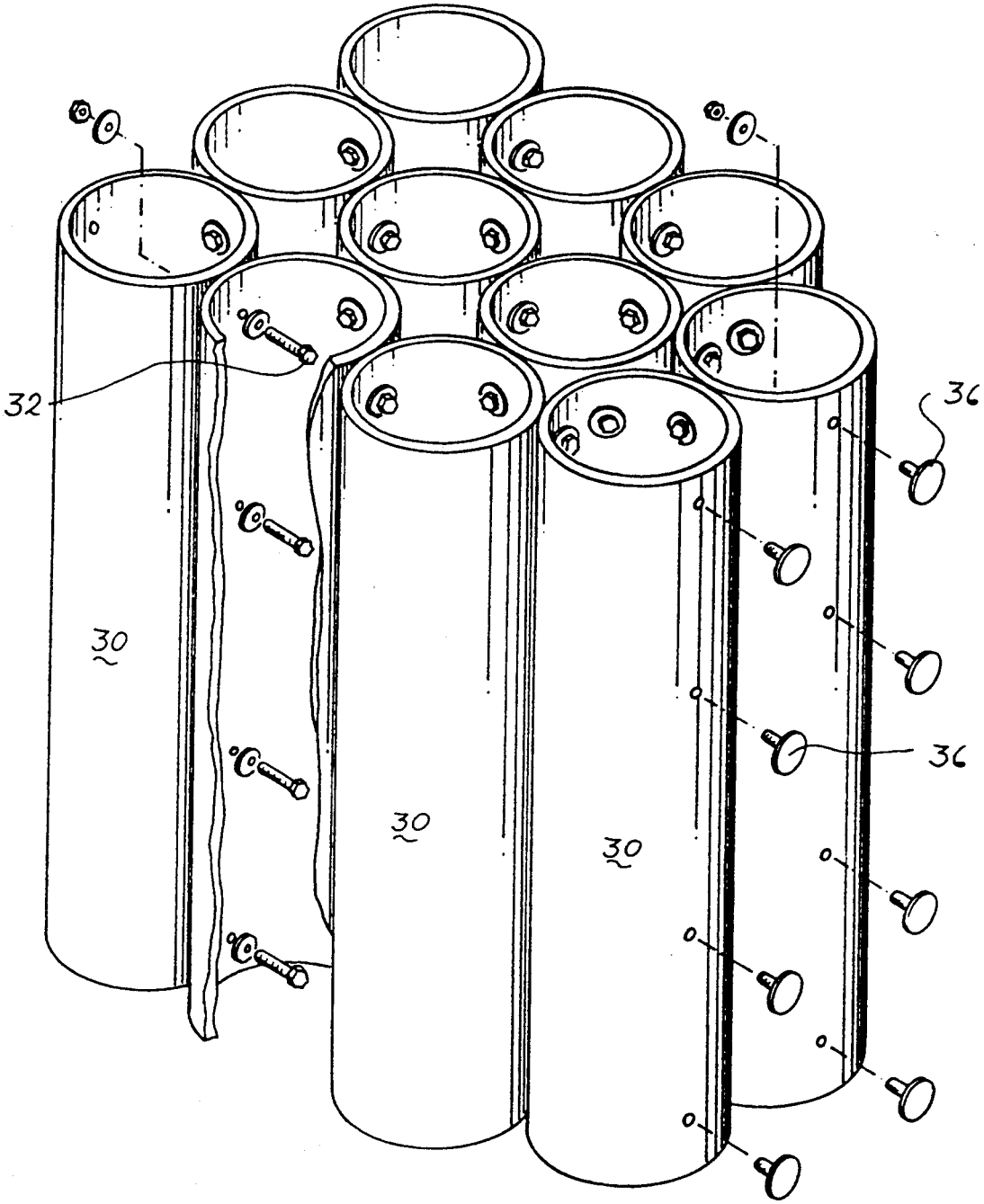
FIG. 7 is a perspective view in partial cut-away of one of the clusters of energy absorbing elements of the crash cushion of FIG. 1.

As best shown in FIGS. 3 and 4, the linkage 16 includes a mounting bracket 18 which in use is mounted directly to the wall W. The mounting bracket 18 in this embodiment defines a ledge 20 that extends generally horizontally away from the wall W and supports the energy absorbing elements 14. The bracket 18 also defines a pivot axis 22 and cable anchors 24, 26. An attachment plate 28 extends partially over the width of the bracket 18, parallel to the wall W. In use, the bracket 18 is rigidly secured to the wall W, as for example with threaded fasteners The energy absorbing elements 14 in this embodiment are shaped as elastomeric tubes 30. Each cluster of energy absorbing elements 14 in this embodiment includes eleven of the tubes 30, and adjacent ones of the tubes 30 are secured together by bolts 32 (FIG. 7). Additionally, one (and only one) of the tubes 30 is bolted to the attachment plate 28 by bolts 34 (FIG. 4). As explained below, this attachment arrangement provides advantages in operation. The two tubes 30 positioned closest to the panels 12 are provided with protruding elements 36 such as flat head bolts intended to provide low friction sliding contact between the tubes 30 and the panels 12.

As best shown in FIG. 3 and 4, the linkage 16 also includes supporting struts 38. Each strut 38 has a lower end that is pivotably mounted to the respective pivot axis 22 and an upper end that is pivotably mounted to a respective strut bracket 40. Each strut bracket 40 additionally defines a pair of cable attachment points 42 as shown in FIG. 4.

The linkage 16 is stabilized by suspension cables 44 and longitudinally extending cables 46 (FIGS. 2 and 4). The suspension cables 44 are positioned almost in the plane of rotation of the struts 38 as shown in FIG. 2, and are anchored at one end to the cable anchor 24 of the respective bracket 18 and at the other end to the strut bracket 40 of the respective panel 12 (FIG. 4). The suspension cables 44 have a fixed length, and thereby limit the maximum rotational movement of the struts 38 away from the wall W. The longitudinally extending cables 46 extend between the cable anchor 26 and the cable attachment point 42 of the respective bracket 18 and strut bracket 40, respectively. The longitudinally extending cables 46 are provided to prevent the struts 38 and therefore the panels 12 from moving excessively along the direction of the arrow A when a vehicle impacts the cushion 10.

Figure 5:
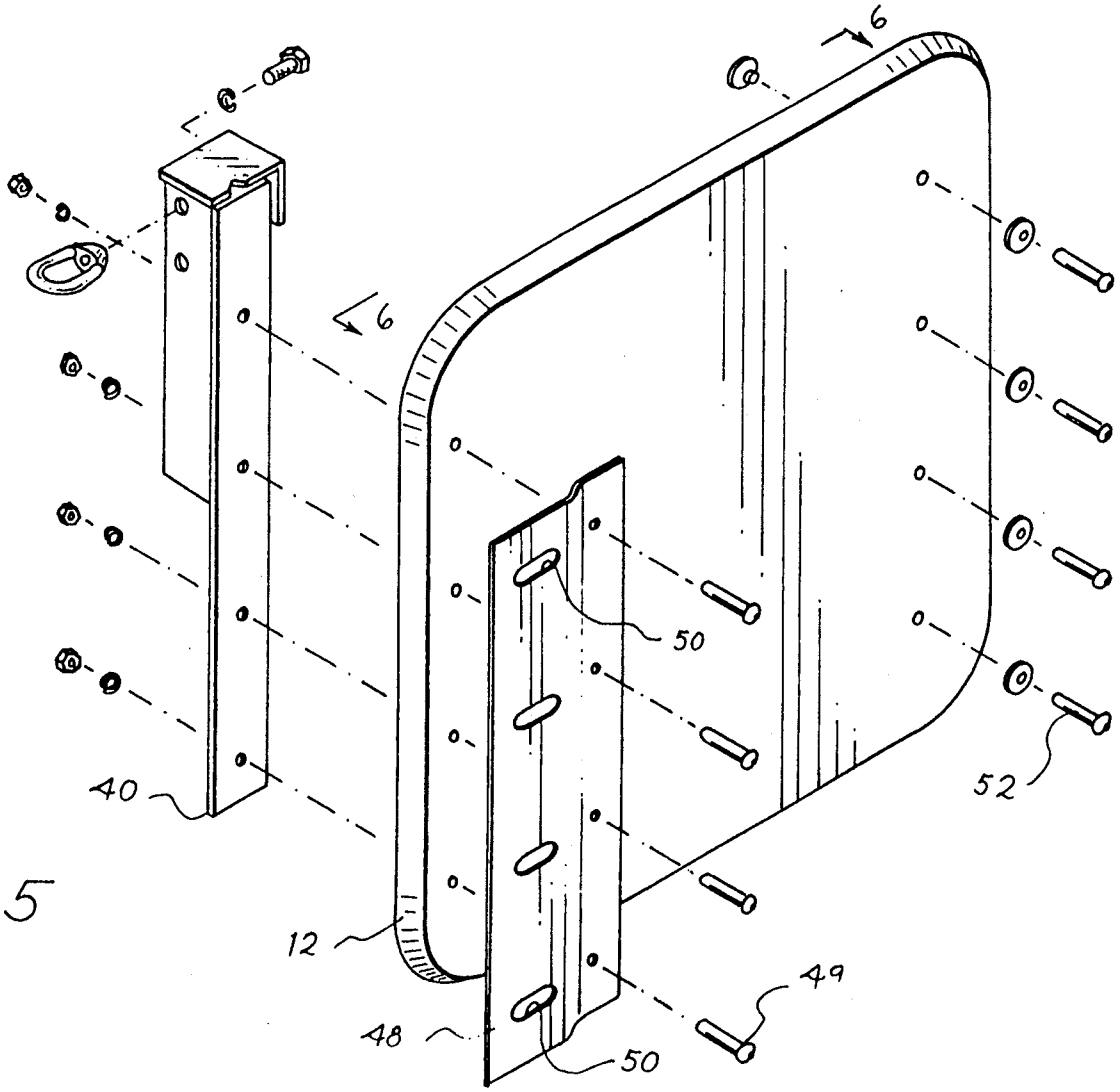
FIG. 5 is an exploded view of one of the panels of FIG. 1, with associated hardware.

Adjacent panels 12 are interconnected by slip joints 48, as best shown in FIG. 5. Each of the slip joints is rigidly secured at one edge via threaded fasteners 49 to the respective panel 12 and strut bracket 40. Each of the slip joints 48 also defines an array of slots 50. Fasteners 52 pass through the slots 50 and are secured to the next adjacent panel 12. Preferably, spacers are provided to prevent the fasteners 52 from being tightened to such an extent as to create excessive friction between the fasteners 52 and the slip joint 48. In this way, relatively free sliding movement is allowed between adjacent panels 12.

When the cushion 10 is mounted to a wall W as shown in FIG. 3, the linkage 16 suspends the panels 12 and the energy absorbing elements 14 above grade. Note that in this example each of the struts 38 is oriented in its rest position at an angle of about 33 degrees with respect to the vertical. The lowermost edges of the panels 12 are situated at least five inches above grade, and the lowermost edges of the energy absorbing elements 14 are situated about ten inches above grade.

In the event of an impact of a vehicle against the cushion 10, the force of the impact will cause the panels 12 to move toward the wall W. This motion is accommodated by rotation of the struts 38, flexing of the suspension cables 44, and sliding of the slip joints 88. As the panels 12 move toward the wall W the energy absorbing elements 14 are elastically deformed between the wall W and the panels 12. In this example the energy absorbing elements 14 have an outside diameter of six inches and a wall thickness of about ½ of an inch. These thick-wall tubes provide substantial resistance to deformation, thereby generating a decelerating force tending to retard movement of the panels 12 toward the wall W, and thereby to decelerate an impacting vehicle.

Figure 6:
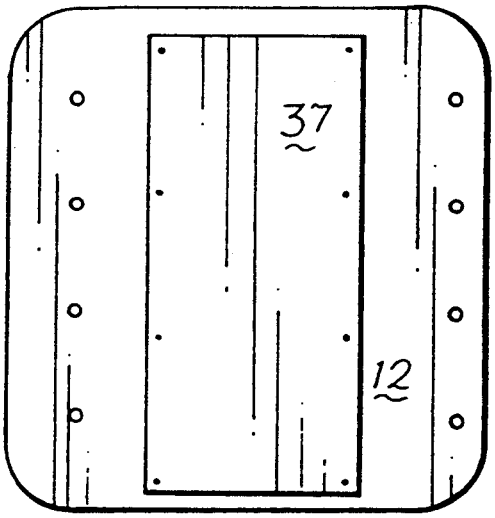
FIG. 6 is a rear view of the panel of FIG. 5, taken along line 6—6 of FIG. 5.
Figure 8:
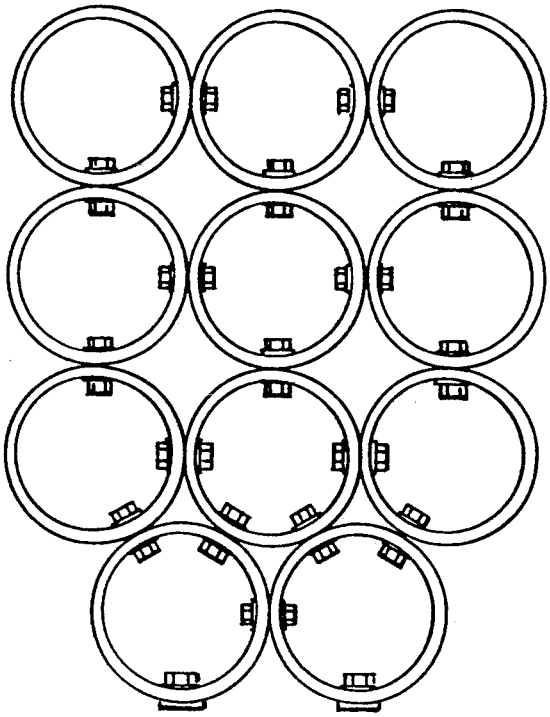
FIG. 8 is a top view of the cluster of energy absorbing elements of FIG. 7.

During an impact the struts 38 lift the panels 12 as the panels 12 approach the wall W. The protruding elements 36 slide along the back side of the panels 12 to facilitate this action. If desired, this portion of the panels 12 can be covered with a suitable low friction material such as a sheet metal plate 37 for example (FIG. 6). Movement of the panels 12 upwardly is believed to enhance the ability of the cushion 10 to decelerate an impacting vehicle while reducing any tendency of the vehicle, to move upwardly over the cushion 10.

The attachment system described above allows the tubes 30 to be elastically deformed without damage to the tubes 30. In particular, since only one of the tubes 30 is bolted to the bracket 18, the tubes 30 can freely increase in length (measured parallel to the wall W) as they are compressed in depth (measured perpendicular to the wall W). This movement would be impeded and the tubes 30 might be damaged if multiple ones of the tubes 30 of any given cluster were rigidly secured to the bracket 18.

The cushion 10 has been designed to be self-restoring for many impacts. As explained above, an impacting vehicle moves the panels 12 toward the wall W, thereby deforming the tubes 30. After the vehicle has moved away from the cushion 10 the resilience of the tubes will cause the panels 12 to move downwardly and outwardly back to the original position. The slip joints 48 facilitate this movement by maintaining the friction between adjacent panels 12 at an acceptable level. The linkage 16 further facilitates this restoring action, because the panels 12 move downwardly as they move outwardly.

The cushion 10 has been designed to minimize installation and maintenance problems. For example, the bracket 18 minimizes the number of attachments required to the wall W. This allows substantial portions of the cushion 10 to be preassembled and then quickly and efficiently mounted on the wall W. Furthermore, all of the elements of the cushion 10 have been designed for reuse. As explained above, the cushion 10 will automatically restore itself to its initial position after an impact, and the energy absorbing elements 14 are not damaged in a typical impact. Because the panels 12 and the energy absorbing elements 14 are suspended above grade by the linkage 16, free movement of the panels 12 back to their original position is not impeded by friction with the ground or low lying obstacles on the ground.

The fact that the panels 12 and the energy absorbing elements 14 are suspended above grade further simplifies maintenance. Because the panels 12 are not in contact with the ground there is reduced water damage. Also, debris such as litter, sand and the like which enters at the top of the cushion 10 tends to fall down through the elements of the cushion 10 to the underlying ground, where it can readily be swept away without obstruction. Interior diaphragm panels have been eliminated, and are therefore not subject to damage. The elastomeric tubes 30 are rugged, and not easily damaged in an impact. The weight of the panel acts to increase the efficiency of energy absorption, because the panel is actually raised during an impact.

Simply by way of example the following details of construction are provided in order to define the presently preferred embodiment of this invention clearly. It of course should be understood that these details of construction are provided only by way of example, and that they are not intended to limit the scope of this invention.

By way of example, the panels 12 can be formed of ¾ inch plywood that has been wrapped with fiberglass monofilament in two orthogonal orientations and then covered with chopped fiberglass and resin to a final thickness of approximately 1¼ inches. The panels can for example be 32 inches in width and 33 inches in height. The tubes 30 can for example be formed of a material with the physical characteristics set out in Table 1.

TABLE 1

| Preferred Material Characteristics of Tube 30 | | |
|---|---|---|
| Item | Approximate Values | Test Method |
| Hardness | 80 Shore A Durometer (+/−3) | ASTM D-2240 |
| Tensile Strength | 3544 psi (minimum) | ASTM D-412 |
| Elongation | 434% (minimum) | ASTM D-412 |
| Modulus at | | |
| 100% Elongation | 615 psi (+10%-5%) | |
| 200% Elongation | 1,678 psi (10%-5%) | |
| 300% Elongation | 2,668 psi (10%-5%) | |
| Compression Set 22 hrs. at 158 Deg. F. | 25% (maximum) | ASTM D-395 Method B |
| Tear Strength | 349 lb/in. (minimum) | ASTM D-624 Die C |
| Specific Gravity | 1.20 (+/−2%) | |

A suitable material can be obtained from R. M. Holtz, Inc. Lodi, Calif. as R8487 rubber. The suspension cables 44 can for example be formed of ¼ inch galvanized wire rope, and the longitudinally extending cables 46 can be formed of ⅜ inch galvalized wire rope. The slip joint 48 can be formed of ⅛ inch thick flat steel bar with slots 2½ inches in length. The struts 38 can be formed of 1¼ inch steel pipe (Schedule 80). The bracket 80 can be welded from suitable steel angles and bars.

Of course, a wide range of changes and modifications can be made to the preferred embodiment described above. This embodiment provides important advantages in that it is self-restoring. However, if this is not essential for a particular application other types of energy absorbing elements including sacrificial energy absorbing elements can be used. The panels described above are preferred, but other rigid panels such as Thrie beams can be used if desired. The lifting linkage described above provides several advantages, but other types of suspending linkages can be substituted (including non-lifting linkages and scissors linkages for example) to suspend the panel and the energy absorbing elements above ground level. The number and angular orientation of the longitudinally extending cables can be modified, as long as the cables extend longitudinally to some extent to resist movement of the panels parallel to the wall.

It is therefore intended that the foregoing detailed description be regarded as illustrative rather than limiting, and that it be understood that it is the following claims, including all equivalents, which are intended to define the scope of this invention.

I claim:

1. A vehicle crash cushion for decelerating a vehicle that has left a roadway and is moving toward a wall, said crash cushion comprising:

a plurality of panels positioned to overlap one another partially along an anticipated impact direction;

a mechanical linkage coupled to the panels to suspend the panels above grade adjacent a wall such that the panels are oriented generally parallel to the wall and the panels are movable toward the wall, said linkage comprising a plurality of support struts, each pivoted at a first end adjacent the wall and at a second end adjacent a respective panel; and a plurality of energy absorbing elements positioned adjacent the panels between the panels and the wall and suspended above grade at least in part by the linkage such that movement of the panels toward the wall deforms the energy absorbing elements, thereby retarding movement of the panels toward the wall.

2. The invention of claim 1 wherein the linkage is configured to raise the panels as the panels move toward the wall.

3. The invention of claim 2 wherein first end of each of the support struts is positioned lower than the respective second end.

4. The invention of claim 3 wherein the linkage further comprises a plurality of suspension cables anchored at one end and coupled to the struts to limit movement of the support struts away from the wall and thereby to hold the panels above grade.

5. The invention of claim 1 wherein each of the energy absorbing elements comprises an elastomeric element.

6. The invention of claim 5 wherein each of the elastomeric elements comprises an elastomeric tube, wherein adjacent ones of the elastomeric tubes are secured together to form a cluster, and wherein only one of the elastomeric tubes in each cluster is secured directly to the wall.

7. The invention of claim 5 wherein the elastomeric elements adjacent the panels define protruding elements which bear on low friction bearing surfaces defined by the panels.

8. The invention of claim 1 wherein adjacent panels are interconnected by slip joints that allow relative movement between adjacent panels in an impact.

9. The invention of claim 1 further comprising a plurality of longitudinally extending cables extending between the wall and respective panels, said longitudinally extending cables oriented to prevent excessive movement of the panels in the anticipated impact direction during an impact.

10. The invention of claim 1 further comprising a plurality of mounting brackets, wherein the mechanical linkage and the energy absorbing elements are mounted to the mounting brackets, and wherein the mounting brackets are mounted to the wall.

11. A vehicle crash cushion for decelerating a vehicle that has left a roadway and is moving toward a wall, said crash cushion comprising:

a plurality of panels positioned to overlap one another partially along an anticipated impact direction;

a plurality of support struts, each hinged at a lower end adjacent the wall and at an upper end adjacent a respective panel, said support struts oriented at an acute angle less than 45° with respect to the wall such that movement of the upper ends toward the wall raises the upper ends;

a plurality of suspension cables anchored at one end and coupled to the struts to limit movement of the support struts away from the wall and thereby to suspend the panels above grade, with the panels oriented generally parallel to the wall and movable toward the wall; and a plurality of elastomeric energy absorbing elements positioned between the panels and the wall and suspended above grade at least in part by the support struts and the cables, such that movement of the panels toward the wall deforms the energy absorbing elements thereby retarding movement of the panels toward the wall.

12. The invention of claim 11 wherein each of the elastomeric elements comprises an elastomeric tube, wherein adjacent ones of the elastomeric tubes are secured together to form a cluster, and wherein only one of the elastomeric tubes in each cluster is secured directly to the wall.

13. The invention of claim 11 wherein at least some of the elastomeric elements are situated adjacent the panels, and wherein the elastomeric elements adjacent the panels define protruding elements which bear on low friction bearing surfaces defined by the panels.

14. The invention of claim 11 wherein adjacent panels are interconnected by slip joints that allow relative movement between adjacent panels in an impact.

15. The invention of claim 11 further comprising a plurality of longitudinally extending cables extending between the wall and respective panels, said longitudinally extending cables oriented to prevent excessive movement of the panels in the anticipated impact direction during an impact.

16. The invention of claim 11 further comprising a plurality of mounting brackets, wherein the struts, the suspension cables and the energy absorbing elements are mounted to the mounting brackets, and wherein the mounting brackets are mounted to the wall.

* * * * *